US009731409B2

(12) United States Patent
Meinzer et al.

(10) Patent No.: US 9,731,409 B2
(45) **Date of Patent: *Aug. 15, 2017**

(54) OUTDOOR TOOL SYSTEM WITH INTERCHANGEABLE MODULAR HEADS

(71) Applicant: Redhed Tools, LLC, Cedar Hills, UT (US)

(72) Inventors: Richard Meinzer, Cedar Hills, UT (US); Jonathan Hart, Salt Lake City, UT (US)

(73) Assignee: Redhed Tools, LLC, Cedar Hills, UT (US)

( * ) Notice: Subject to any disclaimer, the term of this patent is extended or adjusted under 35 U.S.C. 154(b) by 1103 days.

This patent is subject to a terminal disclaimer.

(21) Appl. No.: 13/844,413

(22) Filed: Mar. 15, 2013

(65) Prior Publication Data

US 2014/0137338 A1 May 22, 2014

Related U.S. Application Data

(63) Continuation-in-part of application No. 13/684,008, filed on Nov. 21, 2012.

(51) Int. Cl.

| | |
|---|---|
| ***B25F 1/02*** | (2006.01) |
| ***B25G 1/04*** | (2006.01) |
| ***B25G 3/18*** | (2006.01) |
| ***B25G 3/26*** | (2006.01) |
| ***B25H 3/02*** | (2006.01) |

(52) U.S. Cl.

CPC ..... *B25F 1/02* (2013.01); *B25G 1/04* (2013.01); *B25G 3/18* (2013.01); *B25G 3/26* (2013.01); *B25H 3/02* (2013.01)

(58) Field of Classification Search

CPC A01B 1/022; A01B 1/20; A01B 1/227; B25F 1/02; B25G 1/04; B25G 3/18; B25G 3/26; B25H 3/02

USPC ..... 294/51, 57; 403/348, 349

See application file for complete search history.

(56) References Cited

U.S. PATENT DOCUMENTS

| | | | | | |
|---|---|---|---|---|---|
| 576,756 | A | | 2/1897 | Cole | |
| 810,987 | A | | 1/1906 | Spicer | |
| 1,464,353 | A | | 8/1923 | Crinella | |
| 1,515,820 | A | * | 11/1924 | Adelmann | A01B 1/022 294/51 |
| 1,530,225 | A | | 3/1925 | Belakoy | |
| 2,554,680 | A | * | 5/1951 | Morris | B25H 3/02 206/374 |
| 2,565,466 | A | * | 8/1951 | Barker | A01B 1/222 294/57 |
| 2,606,050 | A | * | 8/1952 | Morris | A01B 1/00 172/371 |
| 2,796,011 | A | | 6/1957 | Schmidt | |

(Continued)

*Primary Examiner* — Dean Kramer

(74) *Attorney, Agent, or Firm* — Morriss O'Bryant Compagni Cannon, PLLC

(57) ABSTRACT

A multipurpose tool system that can be assembled into multiple configurations by a user. The tool system may comprise a plurality of components, including tool heads, shaft segments, and handle ends. The components of the tool system can be combined in various configurations to provide different functions, at different lengths. Connectors may be utilized to connect the various components of the system using a twist lock mechanism. The connectors may include a tubular sleeve member having a biased locking shaft that interacts with a locking groove.

23 Claims, 14 Drawing Sheets

(56) References Cited

U.S. PATENT DOCUMENTS

| | | | | | |
|---|---|---|---|---|---|
| 3,423,781 | A * | 1/1969 | Henson | A47L 13/24 | 15/145 |
| 4,030,150 | A | 6/1977 | Fisher | | |
| 4,162,132 | A | 7/1979 | Kress et al. | | |
| 4,476,939 | A | 10/1984 | Wallace | | |
| 4,700,420 | A | 10/1987 | Belanger | | |
| 4,786,095 | A | 11/1988 | Dumont | | |
| 4,943,182 | A * | 7/1990 | Hoblingre | F16B 7/20 | 403/325 |
| 5,105,493 | A | 4/1992 | Lugtenaar | | |
| 5,226,718 | A | 7/1993 | Lin | | |
| 5,272,788 | A | 12/1993 | Gilstrap | | |
| 5,799,996 | A | 9/1998 | Fredrickson | | |
| 5,915,482 | A * | 6/1999 | Carruthers | A01B 1/227 | 172/375 |
| 5,957,516 | A * | 9/1999 | Jacobs | A01B 1/02 | 294/57 |
| 6,126,359 | A * | 10/2000 | Dittrich | A61B 17/29 | 403/325 |
| 6,439,630 | B1 * | 8/2002 | Eatmon | A01B 1/00 | 206/374 |
| 6,669,397 | B1 * | 12/2003 | Christion | B25G 3/00 | 15/105 |
| 6,925,686 | B2 * | 8/2005 | Heathcock | B25G 1/04 | 15/144.4 |
| 7,219,382 | B2 | 5/2007 | Johnson | | |
| 8,002,491 | B2 * | 8/2011 | Whitling | F16B 7/042 | 16/429 |
| 2010/0192738 | A1 * | 8/2010 | Fenstemaker | B25F 1/00 | 81/489 |
| 2010/0215428 | A1 * | 8/2010 | Trice | B25G 1/04 | 403/359.5 |

* cited by examiner

OUTDOOR TOOL SYSTEM WITH INTERCHANGEABLE MODULAR HEADS

CROSS-REFERENCE TO RELATED APPLICATIONS

This application is a continuation of U.S. patent application Ser. No. 13/684,008, filed Nov. 21, 2012, which is hereby incorporated by reference herein in its entirety, including but not limited to those portions that specifically appear hereinafter, the incorporation by reference being made with the following exception: In the event that any portion of the above-referenced application is inconsistent with this application, this application supercedes said above-referenced application.

STATEMENT REGARDING FEDERALLY SPONSORED RESEARCH OR DEVELOPMENT

Not Applicable.

BACKGROUND

1. The Field of the Present Disclosure

The present disclosure relates generally to tools, and more particularly, but not necessarily entirely, to modular hand tools.

2. Description of Related Art

Hand tools, such as shovels, rakes, and brooms, may comprise a handle attached to a tool head. A user may grasp and manipulate the handle of the hand tool to perform work using the tool head. The work performed by a tool head may include digging, scraping, raking, and sweeping. One drawback to some conventional hand tools is that they may be relatively large in size, making them difficult to store and transport. Another drawback is that purchasing multiple tools may be cost prohibitive, especially when the tools may only be used occasionally.

Some attempts have been made to overcome the aforementioned drawbacks. U.S. Pat. No. 5,799,996 (issued Sep. 1, 1998) discloses a multifunction hand tool that includes a handle assembly comprising a plurality of handle segments. The handle assembly is adapted for use with any one of a plurality of tool heads. U.S. Pat. No. 576,756 (issued Feb. 9, 1897) discloses a sectional tool handle adapted to various tools. The sectional tool handle includes sections of pipe or tube adapted to form the tool handle. U.S. Pat. No. 2,796,011 (issued Jun. 18, 1957) discloses a combination garden tools and sprinkler having multiple attachable tool heads.

While the devices disclosed in aforementioned patents are an improvement, additional solutions are still being sought. For example, the devices disclosed in aforementioned patents lack a certain robustness in design and quality that is often required by today's discriminating consumers. That is, the devices disclosed in aforementioned patents could be improved in both quality and design.

The prior art is thus characterized by several disadvantages that are addressed by the present disclosure. The present disclosure minimizes, and in some aspects eliminates, the above-mentioned failures, and other problems, by utilizing the methods and structural features described herein.

The features and advantages of the present disclosure will be set forth in the description which follows, and in part will be apparent from the description, or may be learned by the practice of the present disclosure without undue experimentation. The features and advantages of the present disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
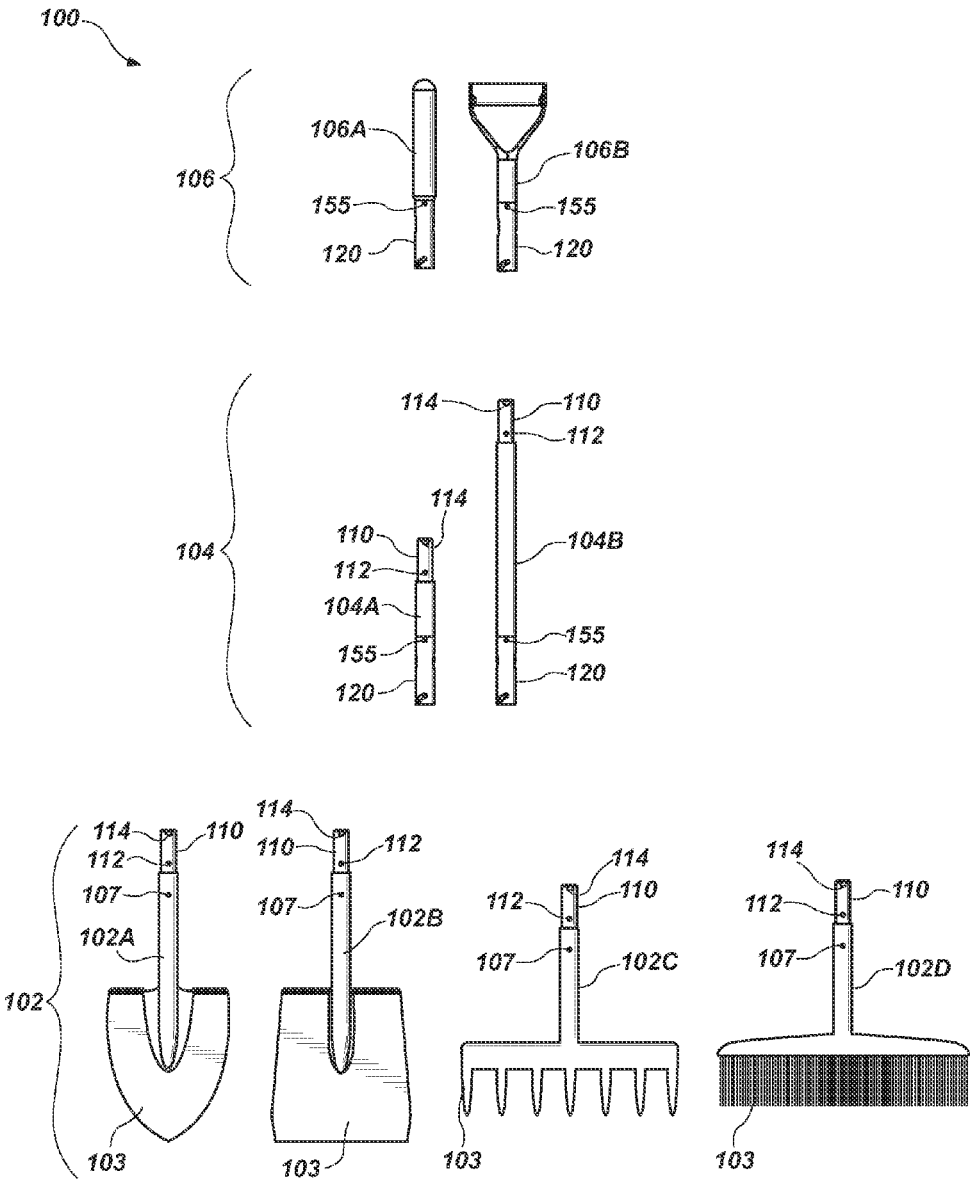
FIG. 1 depicts various components of an outdoor tool system according to an embodiment of the present disclosure.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

In describing and claiming the present disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "having," "characterized by," and grammatical equivalents thereof are inclusive or open-ended terms that do not exclude additional, unrecited elements or method steps.

Applicant has discovered a tool system with interchangeable modular heads. In an embodiment, the tool system may comprise a plurality of handle ends, a plurality of handle shaft segments, and a plurality of tool heads. A user may select any one of the handle ends, any one or more of the shaft segments, and any one of the plurality of tools to put together a customized tool configuration.

In an embodiment, connectors may connect different components of the tool system. The connectors may include a twist lock mechanism for locking different components of the system together. In an embodiment, the handle ends may include a grip, including a straight grip and a D grip. In an embodiment, the shaft segments may include shaft segments of different length. In an embodiment, the tool heads may comprise a spade shovel, a square shovel, a rake, and a broom. Each of the tool heads may have a different function or perform a different task.

The present disclosure may comprise a tool storage system for storing a modular tool system according to the present disclosure. In an embodiment, the tool storage system may comprise a carrying case having a plurality of storage locations for each of a plurality of tool heads, a plurality of shaft segments, and a plurality of handle ends. The tool storage system may provide a compact and easily portable case for the modular tool system disclosed herein.

In an embodiment, the present disclosure may provide a multipurpose tool system that can be assembled into multiple configurations. The tool system may comprise a plurality of components, including tool heads, shaft segments, and handle ends. The components of the tool system can be combined in various configurations to provide different functions, at different lengths. In an embodiment, connectors may be utilized to connect the various components using a twist lock mechanism.

Referring now to FIG. 1, there is depicted a multipurpose outdoor tool system 100 according to an embodiment of the present disclosure. The system 100 comprises components that may be combined in various combinations to provide different functions, at different lengths. The system 100 may comprise a plurality of tool heads 102, a plurality of shaft segments 104, and a plurality of handle ends 106.

Each of the tool heads 102 may comprise a tool head that is able to perform work, such as shoveling, raking, or sweeping. In an embodiment, the plurality of tools heads 102 comprises a spade shovel head 102A, a square shovel head 102B, a rake head 102C, a broom head 102D, a pick head (not shown) as known to those in the field of pick work, a leaf rake (not shown) as known to those in the field of leaf raking, a pitchfork head (not shown) as known to those in the field of pitchfork work, a pick axe head (not shown) as known to those in the field of pick axe work, a sledgehammer head (not shown) as known to those in the field of sledgehammer work, a snow shovel head (not shown) as known to those in the field of snow shoveling, a trenching shovel head (not shown) as known to those in the field of trench shoveling, any broom head as known to those in the field of sweeping or other broom work, a landscape rake (not shown) as known to those in the field of landscape raking, or any suitable tool head capable of performing desired work.

The spade shovel 102A may include an insertion tip 110 that is adapted to be installed into a connector as will be explained hereinafter. In an embodiment, the insertion tip 110 may be fastened to a metal working head 103 by a screw 107. The insertion tip 110 may include a pin 112 extending laterally therefrom, such as a spring-loaded pin that is pushable and thereby displaced in a forward-backward motion as known to those of ordinary skill in the art. Disposed on a terminal end of the insertion tip 110 may be a locking groove 114. In an embodiment, the insertion tip 110 may be formed of wood, or some other sufficiently strong material, such as metal, fiberglass, or plastic. It will be appreciated that each of the other tool heads 102B, 102C and 102D may include an insertion tip 110, a pin 112, and a locking groove 114 as shown in FIG. 1.

Each of the plurality of shaft segments 104 may comprise connection features that allow the shaft segments 104 to connect to each other and the other components of the system 100. In an embodiment, the plurality of shaft segments 104 may comprise a first shaft segment 104A and a second shaft segment 104B. In an embodiment, the first shaft segment 104A and the second shaft segment 104B may be differing lengths. In an embodiment, the first shaft segment 104A and the second shaft segment 104B may be the same length. In an embodiment, the plurality of shaft segments 104 may comprise one or more other shaft segments (not shown) that may differ in length from the first shaft segment 104A and the second shaft segment 104B.

The shaft segment 104A may comprise an insertion tip 110, a pin 112, and a locking groove 114 on a first end. On a second end, opposite the first end, the shaft segment 104A may comprise a connector 120. As will be explained in more detail hereinafter, the connector 120 may be functional to connect the shaft segment 104A to other shaft segments or any one of the tool heads 102. The shaft segment 104B may also comprise an insertion tip 110, a pin 112, and a locking groove 114 on a first end and a connector 120 on a second end.

The plurality of handle ends 106 may comprise a straight grip 106A, or a handle end 106B, or any other suitable free end desired. In an embodiment, the plurality of handle ends 106 may comprise other grip types. The plurality of handle ends 106 may comprise a connection feature that allows the handle ends 106 to connect any one of the plurality of shaft segments 104 or any one of the plurality of tool heads 102. In particular, the straight grip 106A and the D grip 102B may each comprise a connector 120, which will be described in more detail hereafter.

Figures 2A, 2B, 2C, 2D, 2E:
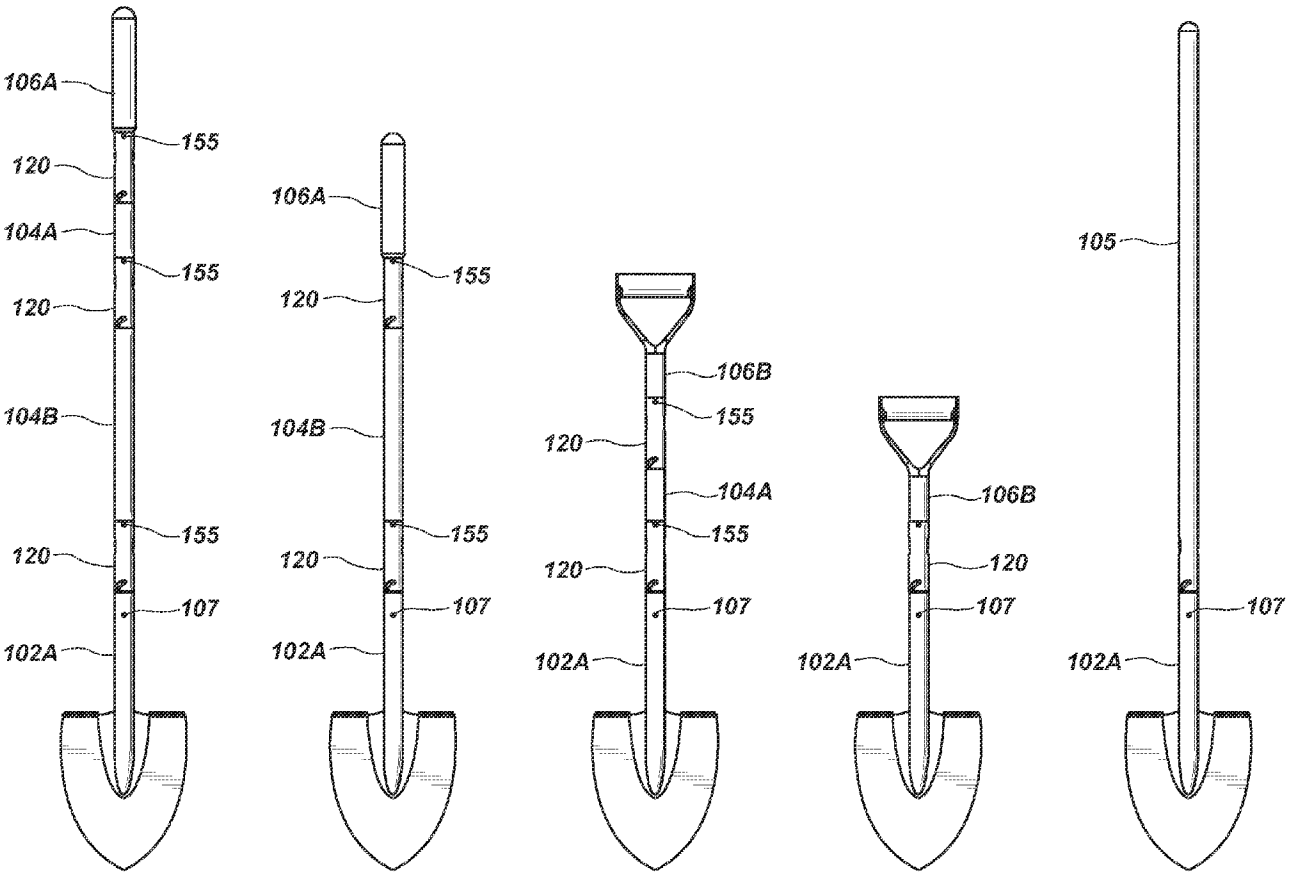
FIGS. 2A-2D depict exemplary configurations of the components of an outdoor tool system depicted in FIG. 1.
FIG. 2E depicts an exemplary embodiment of an outdoor tool system.

Referring now to FIGS. 2A-2D, there are depicted various exemplary combinations of the components of the system 100 according to an embodiment of the present disclosure. In FIG. 2A, the tool head 102A may be coupled to the shaft segment 104B. The shaft segment 104B which may be connected to the shaft segment 104A which may be connected to the handle end 106A. In FIG. 2B, the tool head 102A may be connected to shaft segment 104B which is connected to handle end 106A. In FIG. 2C, the tool head 102A may be connected to shaft segment 104A, which is connected to the handle end 106B. In FIG. 2D, the tool head 102A may be connected directly to handle end 106B.

It will be appreciated that the arrangement of components shown in FIGS. 2A-2D is exemplary, and that the components of the tool system 100 may be arranged in even more configurations than that shown in FIGS. 2A-2D. For example, the tool head 102A may be replaced with any other one of the tool heads 102B, 102C, and 102D. Further, it will be appreciated that the different components may be connected by connectors 120.

Referring now to FIG. 2E, there is depicted the tool head 102A mounted on a shaft segment 105. The shaft segment 105 may have an integrated connector 120. It is therefore to be understood that an embodiment of the present disclosure may include a single, one-piece, unitary shaft segment 105, to which a single tool head such as tool head 102A or any other suitable tool head, is removably attached, preferably but not necessarily by way of a connector 120 integrated within the shaft segment 105.

Figure 3A:
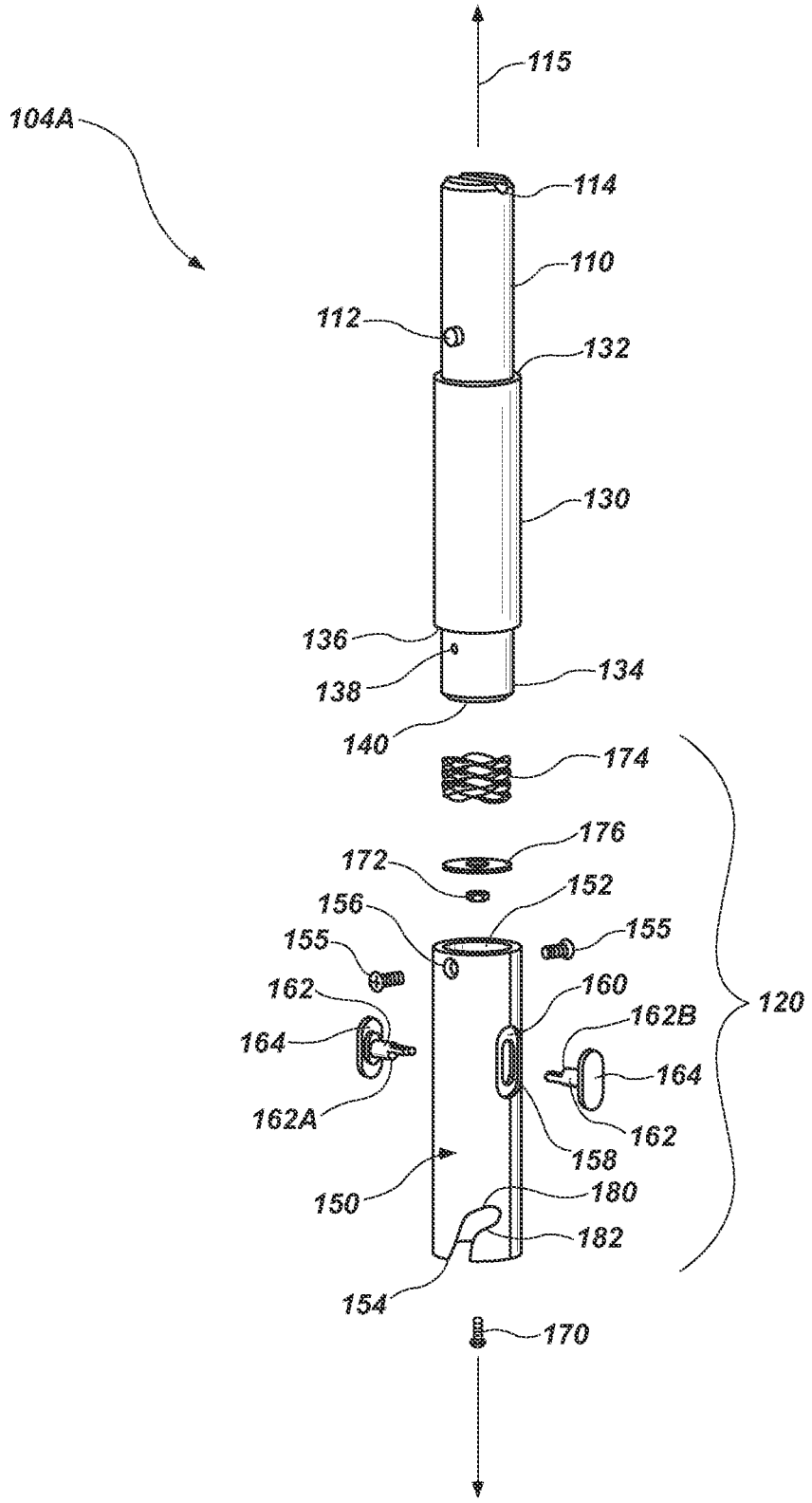
FIG. 3A depicts an exploded view of an exemplary shaft segment according to an embodiment of the present disclosure.

Referring now to FIG. 3A, there is depicted an exploded view of the shaft segment 104A. The shaft segment 104A may comprise a body portion 130. The insertion tip 110 may extend from the body portion 130. The insertion tip 110 may have a diameter smaller than the diameter of the body portion 130 to thereby form an annular rim 132. The locking groove 114 may be disposed in a terminal end of the insertion tip 110.

The pin 112 may extend laterally from a sidewall of the insertion tip 110 and perpendicular to a longitudinal axis 115 of the shaft segment 104A. Disposed on the end of the body member 130 opposite of the insertion tip 110 may be an insertion tip 134. The insertion tip 134 may have a diameter smaller than the diameter of the body member 130 to thereby form an annular rim 136.

The connector 120 may include a tubular sleeve member 150. The tubular sleeve member 150 may define a first socket 152 at a top end and a second socket 154 at a bottom end. The first socket 152 may be adapted to receive the insertion tip 134. Fasteners 155, such as screws, may secure the tubular sleeve member 150 to the insertion tip 134. In particular, the fasteners 155 may be inserted through bores 156 in the tubular sleeve member 150 and threaded into bores 138 in the insertion tip 134.

Elongated slots 158 may be formed in the tubular sleeve member 150. A locking shaft 162 may be formed from locking shaft segments 162A and 162B. In an embodiment, the locking shaft segments 162A and 162B may be joined by a fastener assembly that includes a threaded fastener 170 and a nut 172. In an embodiment, the locking shaft 162 may extend through an interior of the tubular sleeve member 150. The locking shaft 162 may be disposed in, and guided by, the elongated slots 158 such that the locking shaft 162 may move up and down in the slots 158.

A recessed portion 160 may surround each of the slots 158. The recessed portions 160 may be adapted to receive release buttons 164 disposed on the end of the locking shaft 162. In an embodiment, the release buttons 164 may be able to slide up and down in the recessed portions 160 in response to user input.

A biasing member 174 may be disposed in the tubular sleeve member 150 between a bottommost end 140 of the insert tip 134 and a washer 176. The biasing member 174 may bias the locking shaft 162 in the elongated slots 158. In an embodiment, the biasing member 174 is a wave spring. In an embodiment, the biasing member 174 may be any other resilient device.

Formed in the tubular sleeve member 150 may be a pin guide slot 180 for guiding the pin 112 of another one of the components. In an embodiment, the pin guide slot 180 may be curved. The pin guide slot 180 may include a cam surface 182 that forms a cam mechanism with the pin 112 of another one of the components. The cam mechanism may be operable to translate rotation of an insert tip 110 of another one of the components into a linear motion.

Figure 3B:
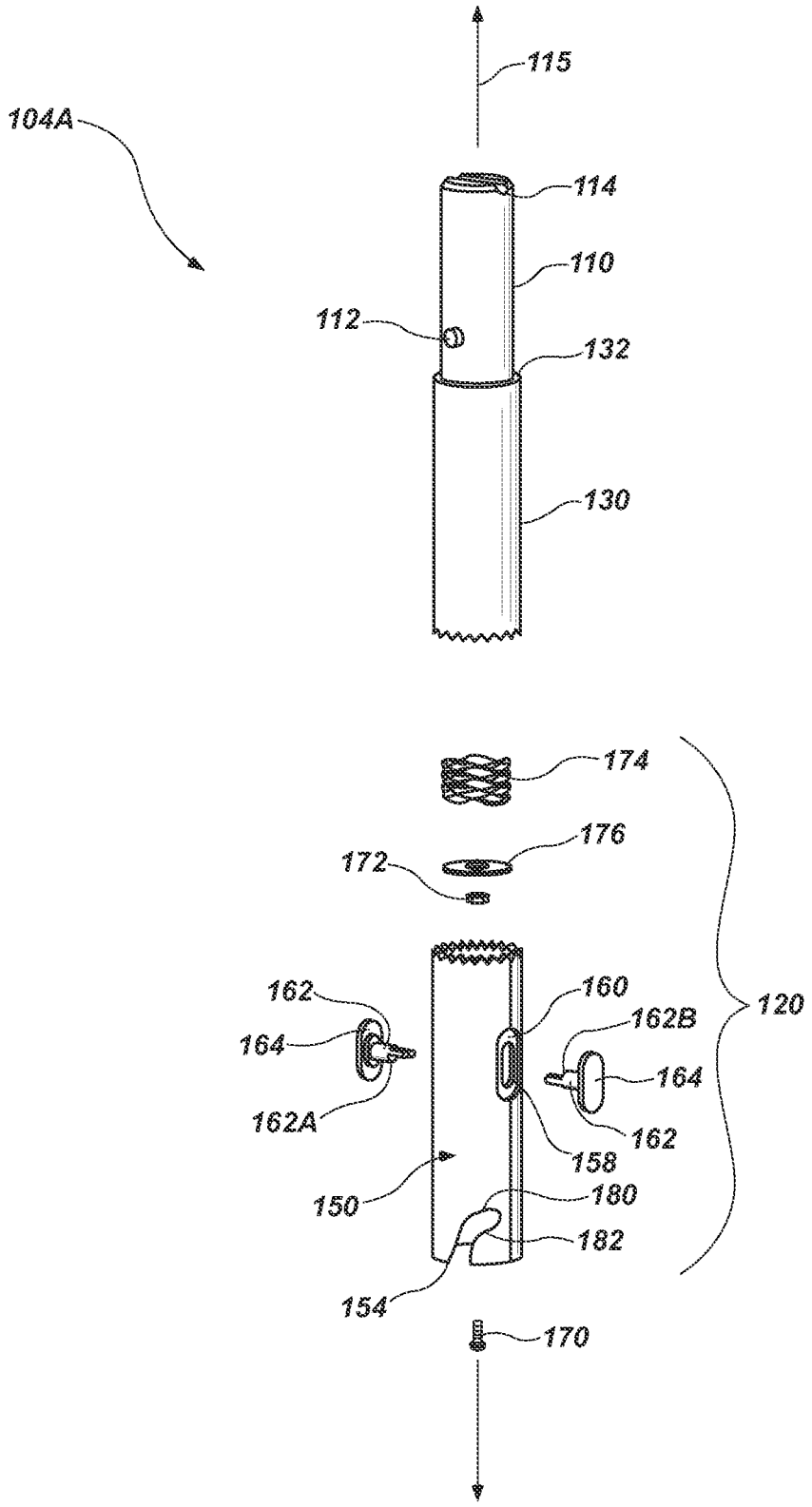
FIG. 3B depicts an exploded, fragmentary view of an exemplary shaft segment according to an embodiment of the present disclosure.

Referring now to FIG. 3B, there is depicted an exploded, fragmentary view of the shaft segment 104A of FIG. 3A, according to an embodiment of the present disclosure, where like reference numerals depict like components. The biasing member 174 may be biased against the locking shaft 162 by any suitable mechanism, including by the body member 130, or by an insert, or by a pin, or by a washer, or by a blocking member, or by a screw, or by a projection, or by a surface, or in some other manner, all of which fall within the scope of the present disclosure.

Figure 4:
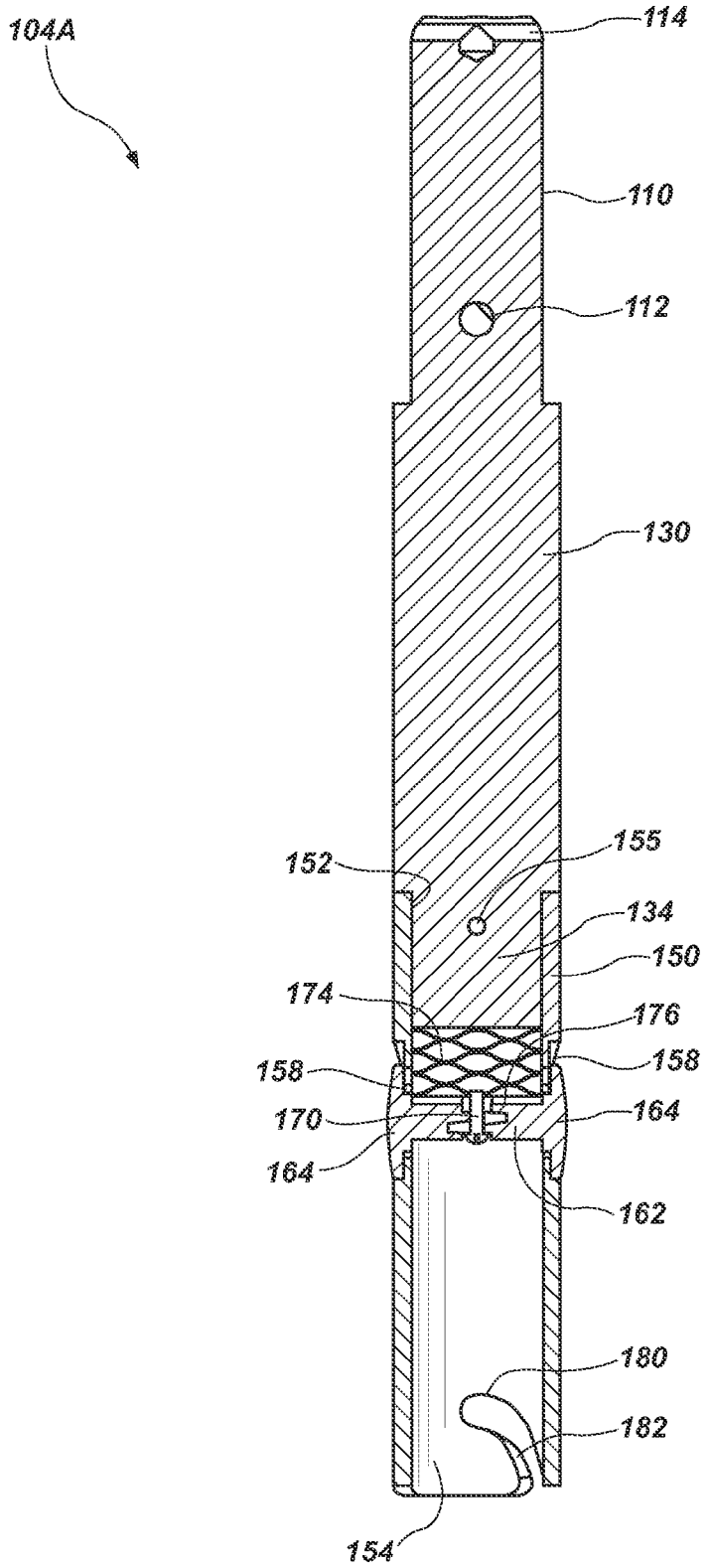
FIG. 4 is a cross-sectional view of the exemplary shaft segment shown in FIG. 3A.

Referring now to FIG. 4, where like reference numerals indicate like components, there is shown a cross-sectional view of the shaft segment 104A. As can be observed, the tip 134 of the body member 130 may be installed into the first socket 152 of the tubular sleeve member 150 and secured by the fasteners 155. The biasing member 174 may bias the washer 176 against the locking shaft 162 such that the locking shaft 162 is biased toward the opening of the second socket 154.

Figure 5C:
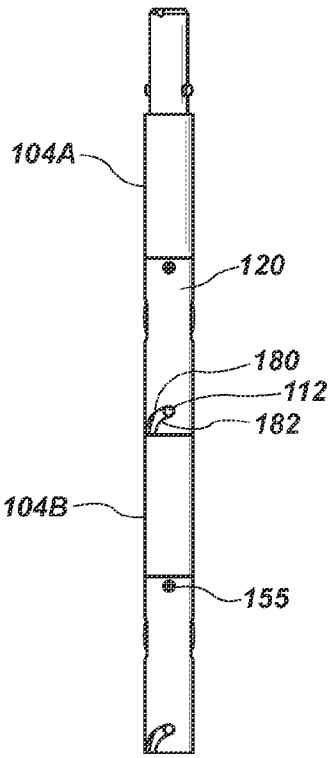
FIGS. 5A, 5B, and 5C depict an exemplary procedure for coupling a first shaft segment and a second shaft segment in an end-to-end configuration to form a handle assembly.
Figure 5B:
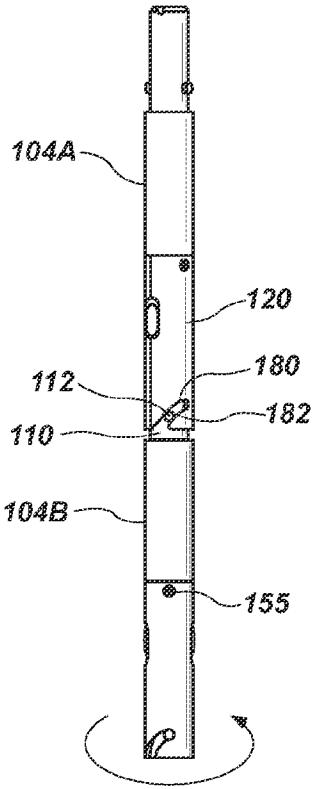
Figure 5A:
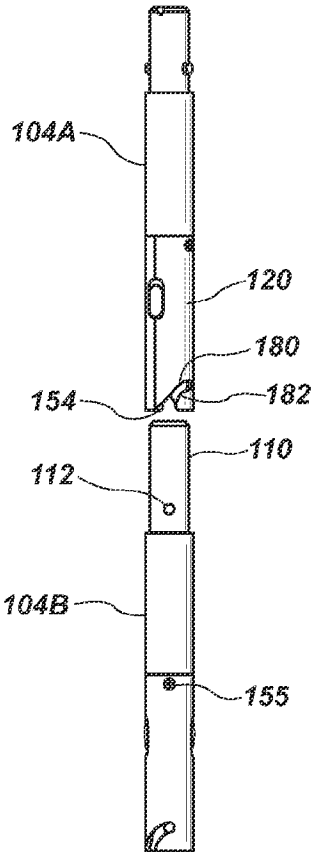

Referring now to FIGS. 5A-5C, there is shown a method of connecting the shaft segment 104A to the shaft segment 104B using the connector 120. As shown in FIG. 5A, the insertion tip 110 of the shaft segment 104B may be guided into the second socket 154 of the connector 120. The pin 112 of the shaft segment 104B may be guided into the pin guide slot 180.

As shown in FIG. 5B, the shaft segment 104B may be rotated such that the pin guide slot 180, and in particular, the cam surface 182, interacts with the pin 112 such that the rotational movement is translated into a linear movement to thereby force the insertion tip 110 deeper into the second socket 154. As shown in FIG. 5C, the pin 112 is disposed at the end of the pin guide slot 180 and the insertion tip 110 is fully installed into the second socket 154.

Figure 6:
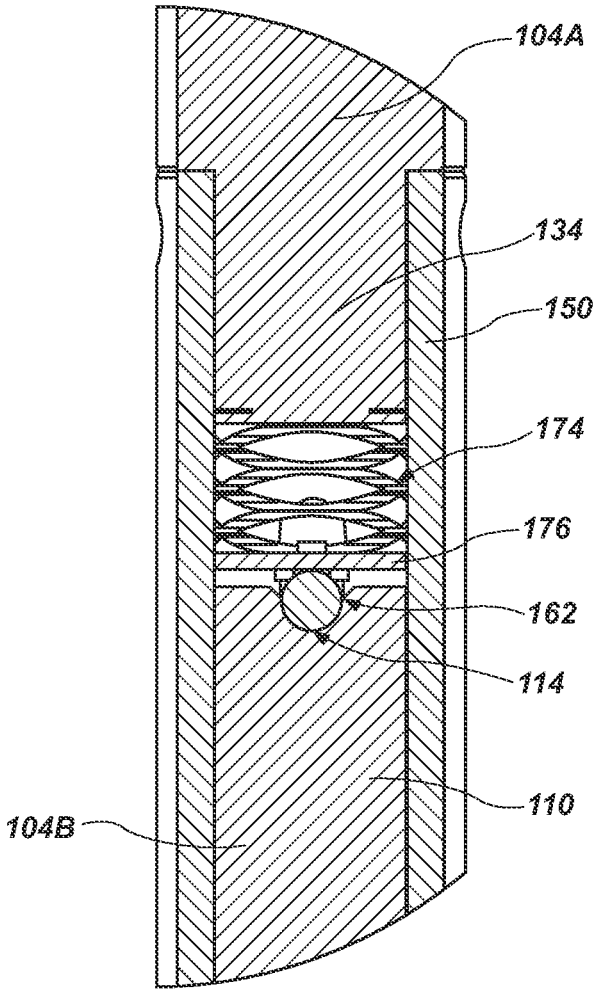
FIG. 6 is a fragmentary, cross-sectional view of a connection between a first shaft segment and a second shaft segment according to an embodiment of the present disclosure.

Referring now to FIGS. 5C and 6, as the pin 112 of the shaft segment 104B is rotated in the pin guide slot 180, the cam surface 182 guides the pin 112, and hence the insertion tip 110 of the shaft segment 104B, deeper into the second socket 154 such that the end of the insertion tip 110 may begin to push against the locking shaft 162. When the locking groove 114 on the end of the insertion tip 110 is in alignment with the locking shaft 162, the locking shaft 162 may be forced into the groove 114 by the biasing member 174 as shown in FIG. 6. The interaction of the locking shaft 162 and the locking groove 114 connect the shaft segments 104A and 104B end-to-end. It will be appreciated that the shaft segment 104B is shown in a "locked" position meaning that the locking shaft 162 is disposed in the locking groove 114. An "unlocked" position may be anytime the locking shaft 162 is not disposed in the locking groove 114.

Figure 7:
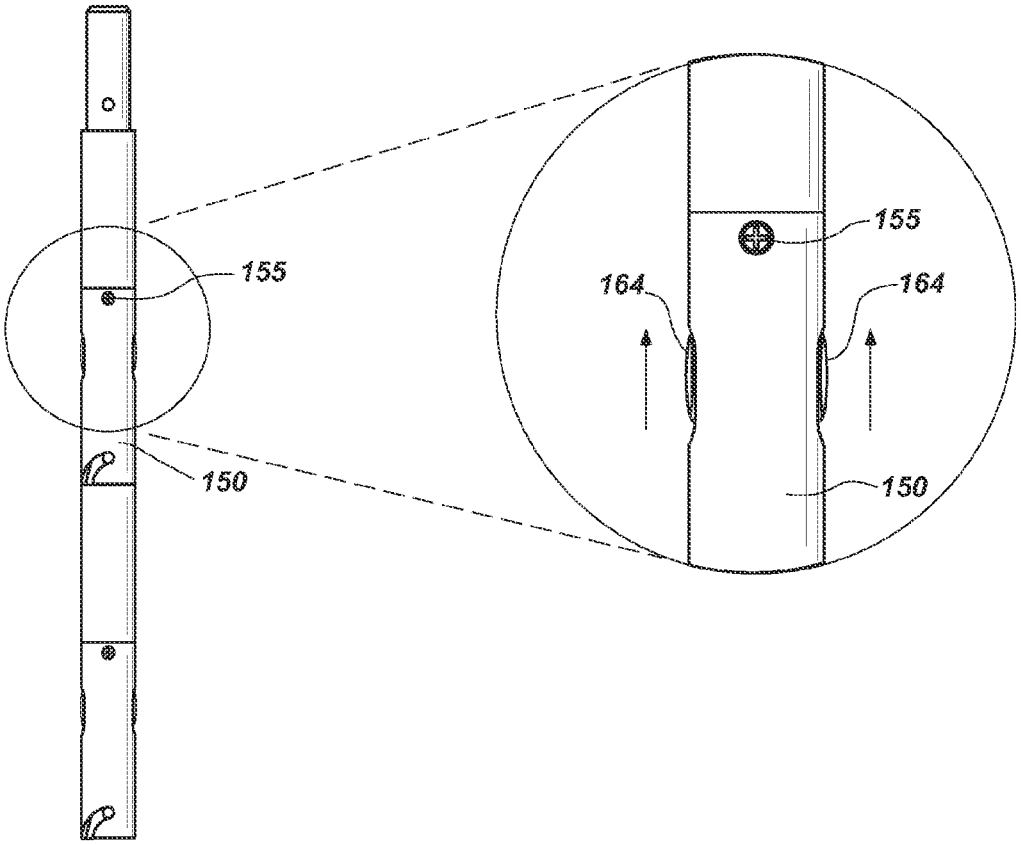
FIG. 7 depicts a manual release procedure to release a first shaft segment and a second shaft segment.

Referring now to FIGS. 5C, 6 and 7, to disconnect the shaft segment 104A and the shaft segment 104B, the locking shaft 162 may need to be released from the locking groove 114. In order to release the locking shaft 162, a user may slide buttons 164 upwards in the elongated slots 158 as shown in FIG. 7. This action may move the locking shaft 162 out of the locking groove 114 such that the shaft segments 104A and 104B may be disconnected by a rotational movement, opposite of that shown in FIGS. 5A-5C.

It will be appreciated that any of the components of the tool system 100 may be connected and disconnected to other components as described above in relation to FIGS. 5A-7.

Figure 8A:
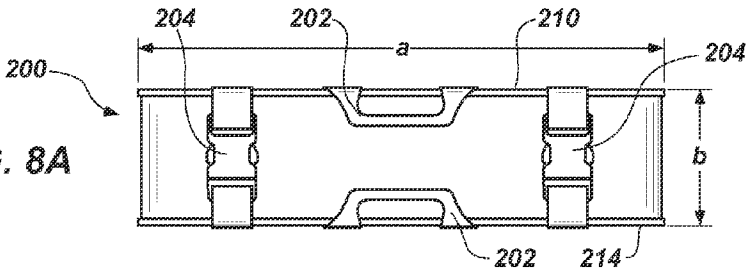
FIGS. 8A, 8B, 8C, and 8D depict a top view, a side view, an end view and a bottom view of a carrying case for the outdoor tool system shown in FIG. 1 according to an embodiment of the present disclosure.
Figure 8B:
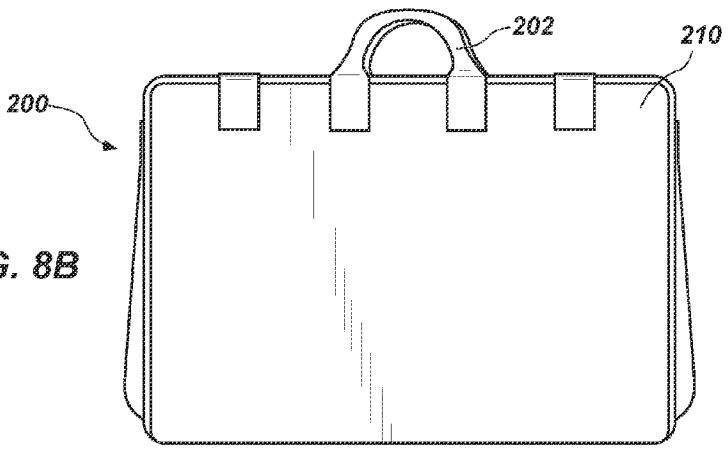
Figure 8C:
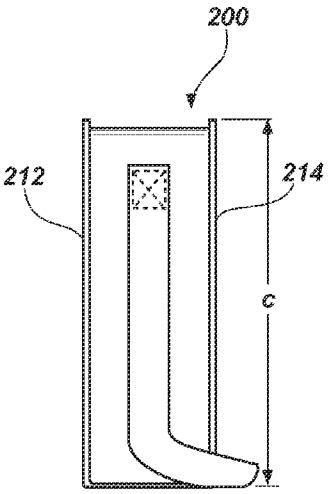
Figure 8D:
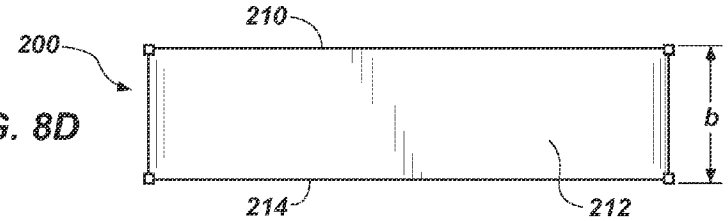
Figure 9:
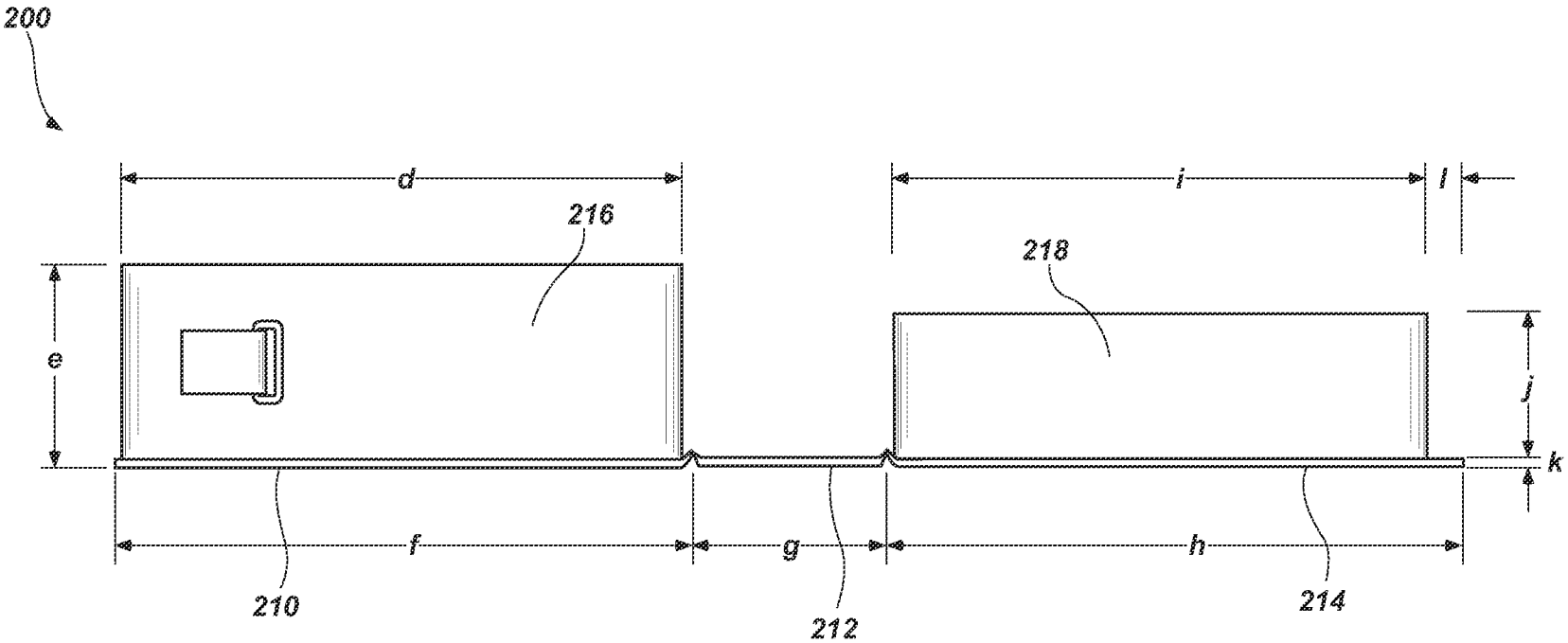
FIG. 9 is a side view of the carrying case shown in FIGS. 8A-8D in the open position.
Figure 10:
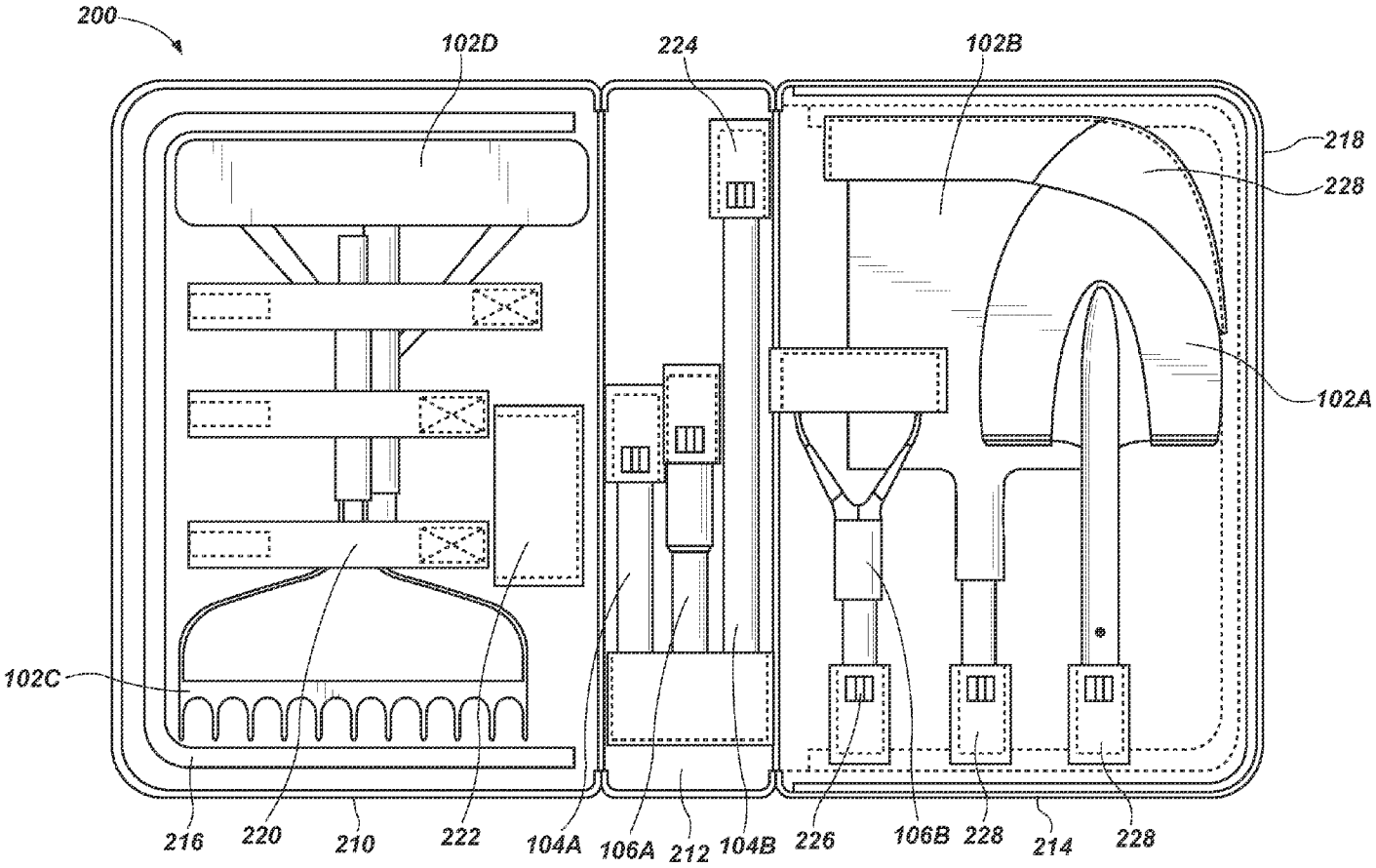
FIG. 10 is a top view of the carrying case shown in FIGS. 8A-8D in the open position.

Referring now to FIGS. 8A-10, the present disclosure may include a carrying system 200 for storing the outdoor tool system 100. The carrying system 200 may comprise a pair of flexible carrying handles 202. In an embodiment, the carrying system 200 may be configurable between a closed position as shown in FIGS. 8A-8D and an open position as shown in FIGS. 9 and 10. A pair of buckles 204 (FIG. 8A) may be utilized to secure the system 200 in the closed position.

The system 200 may include a first side panel 210, a middle panel 212, and a second side panel 214. The middle panel 212 may connect the first side panel 210 and the second side panel 214. The first side panel 210 and the middle panel 212 may be connected by a living hinge. The second side panel 214 and the middle panel 212 may also be connected by a living hinge.

As best seen in FIGS. 9 and 10, extending upwardly from the first side panel 210 may be a wall 216. The wall 216 may be three sided such that it does not extend along the portion nearest the middle side panel 212. Extending upwardly from the second side panel 214 may be a wall 218. The wall 218 may be three sided such that it does not extend along the portion nearest the middle side panel 212. The dimensions of the wall 218 may be just slightly larger than those of the wall 216 such that when the case 200 is moved to the closed position, the wall 216 may just fit inside of the perimeter of the wall 218.

Referring now to FIG. 10, the interior side of the first side panel 210 may include a storage location for the rake head 102C and the broom head 102D. The rake head 102C and the broom head 102D may be secured by straps 220. In particular, the straps 220 may be secured with hook and latch strip. The interior side of the first side panel 210 may include an accessories pocket 222.

The interior side of the middle panel 212 may include a storage location for the handle end 106A and the shaft segments 104A and 104B. Elastic pockets 224 may secure the handle end 106A and the shaft segments 104A and 104B to the middle panel 212.

The interior side of the second side panel 214 may include a storage location for the handle end 106B, the spade shovel head 102A, and the square shovel head 102B. The handle end 106B may be secured by elastic pockets 226. The tips of the spade shovel head 102A, and the square shovel head 102B may be secured by pockets 228.

Referring to FIGS. 8A-9, in an embodiment, the carrying system 200 may be dimensioned as indicated in Table 1.

TABLE 1

| Dimension | Length (inches) |
|---|---|
| a | 22"-28" or 24.25" |
| b | 4"-8" or 6" |
| c | 14"-20" or 16.5" |
| d | 14"-20" or 16" |
| e | 4"-8" or 5.75" |
| f | 14"-20" or 16.5" |
| g | 4"-8" or 5.5" |
| h | 14"-20" or 16.5" |
| i | 14"-20" or 15" |
| j | 3"-6" or 4" |
| k | .1"-.4" or .2" |
| l | .5"-1.5" or 1" |

In an embodiment, the carrying system 200 may be hard-sided or soft-sided case.

Figure 11:
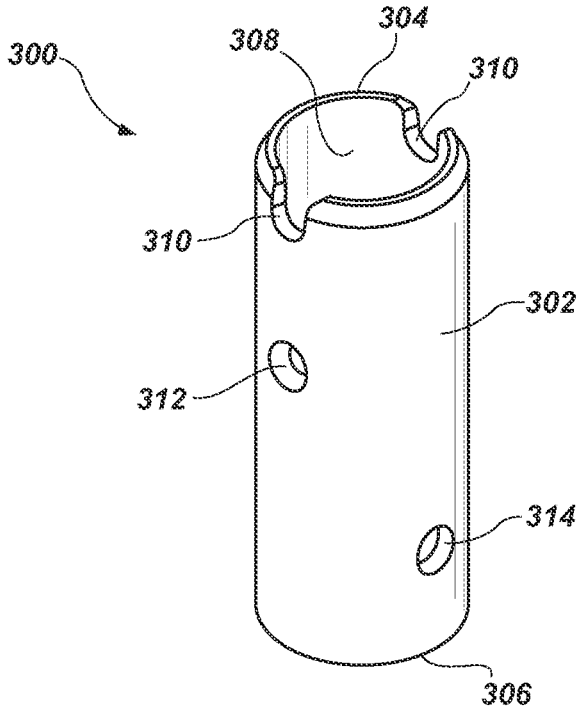
FIG. 11 is a perspective view of a tubular sleeve member according to an embodiment of the present disclosure.

Referring now to FIG. 11, there is depicted a tubular sleeve member 300 that may be utilized to connect two components in an end-to-end manner to form a handle assembly. The tubular sleeve member 300 may include a tubular body 302 extending between an annular top edge 304 and an annular bottom edge 306. The tubular body 302 may define a hollow passageway 308 that extends between the annular top edge 304 and the annular bottom edge 306.

The annular top edge 304 of the tubular body 302 may define a groove 310. It is to be understood that both grooves 310 shown in FIG. 11 in alignment, may be described herein as a single "groove," given the function similarity of groove 310 and groove 114 of FIG. 3A, as explained below.

In an embodiment, the groove 310 is configured and adapted to receive a locking shaft, such as locking shaft 162 described above. In this regard, the groove 310 may operate in the same manner of the groove 114 described above (in, e.g., FIGS. 1, 3A, 3B and 4). Holes 312 in the tubular body 302 may be configured and adapted to receive fasteners. A hole 314 may be configured and adapted to receive a pin, such as the pin 112 described above (in, e.g., FIGS. 1, 3A, 3B and 4), that forms part of a cam mechanism.

The annular bottom edge 306 may define an opening to a socket formed by the hollow passageway 308. As will be explained in more detail hereinafter, the socket may be configured and adapted to receive an insertion tip of a shaft segment or tool head.

An outer diameter of the sleeve member 300 may be configured and dimensioned to fit within a socket of a second tubular sleeve member, such as the connector that is sleeve member 150 described above (in, e.g., FIGS. 3A, 3B, 4 and 6). Consider then, that by the disclosure provided in FIGS. 11-15, insertion tip 110 described above (in, e.g., FIGS. 3A, 3B and 4) may in effect be replaced by a first insertion tip 320 (shown in FIGS. 12-13) and the sleeve 300, in which the groove 310 being formed in the upper edge of sleeve 300 provides the function that groove 114 (in, e.g., FIGS. 3A, 3B and 4) performs. The first insertion tip 320 and the sleeve 300 may be referred to herein as a "composite insertion tip." As such, this alternative combination involving sleeve 300 as shown in FIGS. 11-15, and operating as noted above in conjunction with connecting sleeve 150 might, for example, be referred to as a "sleeve within a sleeve," in that sleeve 300 would reside within sleeve 150, according to the above, and according as follows.

The tubular sleeve member 300 may rotate about a longitudinal axis between a locked position and an unlocked position in the sleeve member 150 (in, e.g., FIGS. 3A, 3B, 4 and 6) such that the locking groove 310 engages the locking shaft 162, in a similar manner to the locking groove 114 described above (in, e.g., FIGS. 3A, 3B, 4 and 6). A pin installed in the hole 314 and extending laterally from the tubular body 302, may engage the cam surface 182 of the sleeve member 150 in a similar manner to the pin 112 described above (in, e.g., FIGS. 3A, 3B, 4, 5A, 5B, 5C and 6). In an embodiment, the tubular sleeve member 300 is formed from metal.

Figure 12:
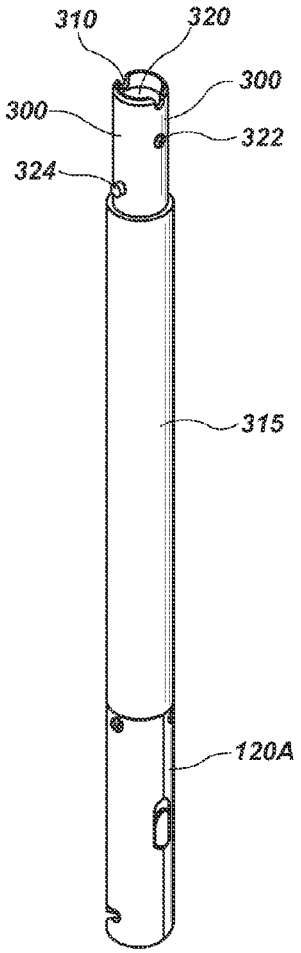
FIG. 12 is a view of a shaft segment.
Figure 13:
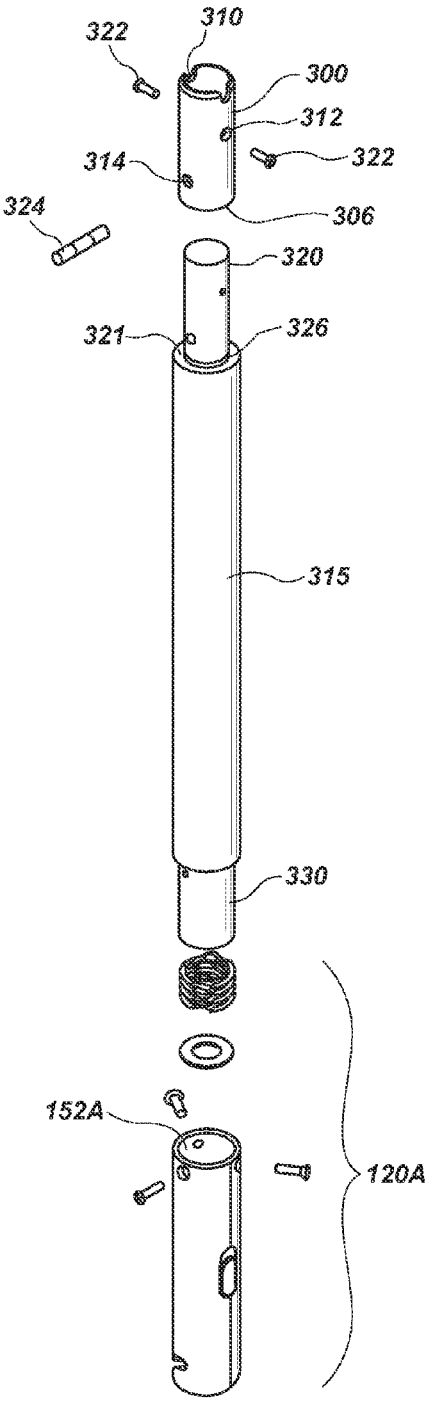
FIG. 13 is an exploded view of the shaft segment shown in FIG. 12.

Referring now to FIGS. 12 and 13, where like reference numerals depict like components, the first insertion tip 320 extending from an end of a shaft segment 315 may be installed into a socket of the tubular sleeve member 300. The first insertion tip 320 may extend from an end surface 321 of the shaft segment 315. The first insertion tip 320 may have a diameter smaller than that of the end surface 321. The end surface 321 may engage the annular bottom edge 306 of the tubular sleeve member 300. The diameter of the tubular sleeve member 300 may be between the diameter of the first insertion tip 320 and the diameter of the end surface 321.

Fasteners 322 installed into holes 312 may be utilized to secure the tubular sleeve member 300 onto the insertion tip 320. A pin 324 may be installed into hole 314 of the tubular sleeve member 300, and may operate and function similar to the function of pin 112 of e.g. FIGS. 1, 3A, 3B, 4, 5A, 5B and 5C. An annular relief channel 326 formed in the base of the first insertion tip 320 may ensure proper installation of the tubular sleeve member 300 by preventing binding.

A second insertion tip 330 may be installed into the first socket 152A of a connector assembly 120A. The connector assembly 120A may take substantially the same form as the connector assembly 120 described above and therefore will not be described in detail at this juncture.

Figure 15:
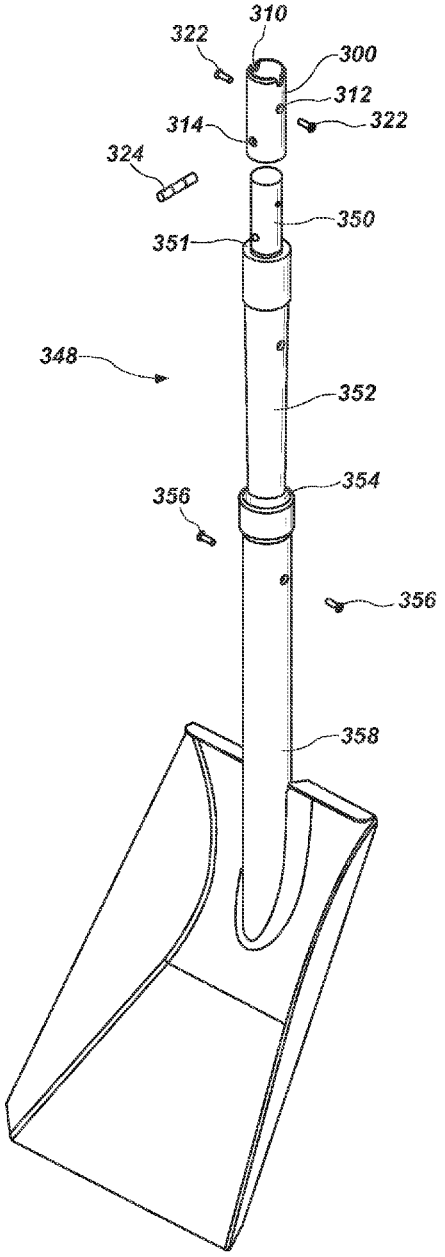
FIG. 15 is an exploded view of the tool head shown in FIG. 14.
Figure 14:
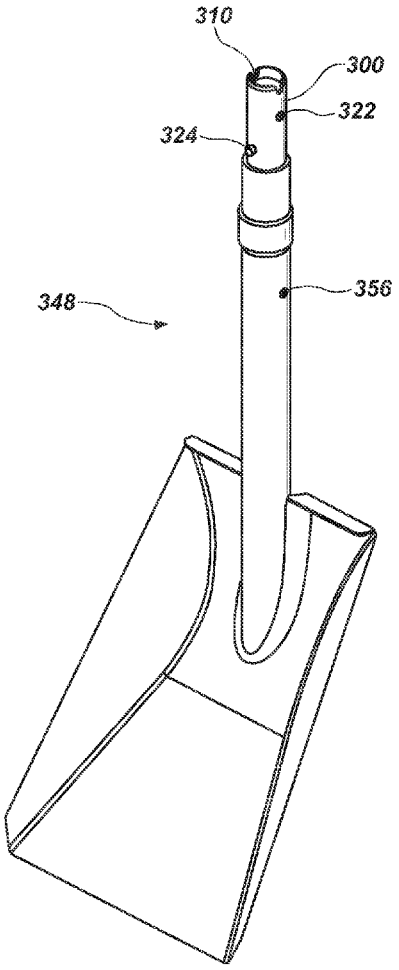
FIG. 14 is a view of a tool head.

Referring now to FIGS. 14 and 15, where like reference numerals depict like components, there is shown a tool head 348 according to an embodiment of the present disclosure. A first insertion tip 350 of the tool head 348 may be installed into a socket of the tubular sleeve member 300. Fasteners 322 installed into holes 312 may be utilized to secure the tubular sleeve member 300 onto the first insertion tip 350. A pin 324 may be installed into a hole 314 of the tubular sleeve member 300. A relief channel 351 formed in the base of the first insertion tip 350 may ensure proper installation of the tubular sleeve member 300 and prevent binding.

A second insertion tip 352 may be installed into a socket 354 of a work head 358. Fasteners 356 may secure the tip 352 to the work head 358. It will be appreciated that although the tool head 358 is shown having a square head shovel, the tool head 358 may include another work end, including a broom, a rake, or a round head shovel.

It will be appreciated that the tubular sleeve member 300 may prevent wear of a locking groove in a wooden shaft due to the fact that is constructed of a more durable material, such as metal. In particular, the locking groove 310, formed from metal, may not experience the same wear as a wooden locking groove, such as locking groove 114 shown in FIG. 3A. It will be further appreciated that the tubular sleeve member 300 may be installed over any of the insertion tips described herein.

In an embodiment, a modular hand tool according to the present disclosure may comprise a first tubular sleeve member, such as sleeve member 150, that defines a first socket and a second socket. An insertion tip of a first shaft segment may be installed into the first socket of the first tubular sleeve member. A second tubular sleeve member, such as sleeve member 300, may define a first socket having an insertion tip of a second shaft segment installed therein. The second tubular sleeve member may be configured and dimensioned to be removably inserted into the second socket of the first tubular sleeve member. The second tubular sleeve member may be rotatable about a longitudinal axis between a locked position and an unlocked position with respect to the first tubular sleeve member. A biased locking shaft may automatically engage a locking groove formed in an edge of the second tubular sleeve member.

It will be appreciated that the structure and apparatus disclosed herein is merely one example of a means for connecting components of a tool system, and it should be appreciated that any structure, apparatus or system for connecting components of a tool system which performs functions the same as, or equivalent to, those disclosed herein are intended to fall within the scope of a means for connecting components of a tool system, including those structures, apparatus or systems for connecting components of a tool system which are presently known, or which may become available in the future. Anything which functions the same as, or equivalently to, a means for connecting components of a tool system falls within the scope of this element.

Those having ordinary skill in the relevant art will appreciate the advantages provided by the features of the present disclosure. For example, it is a feature of the present disclosure to provide a modular tool system that includes a plurality of components that may be configured in various configurations.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description of the Disclosure by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A hand tool comprising:

a first tubular sleeve member defining a first socket and a second socket;

a first shaft segment having a tip installed into the first socket of the first tubular sleeve member;

a second tubular sleeve member defining a first socket;

a second shaft segment having a tip installed into the first socket of the second tubular sleeve member;

wherein the second tubular sleeve member is configured and dimensioned to be removably inserted into the second socket of the first tubular sleeve member;

wherein the second tubular sleeve member is rotatable about a longitudinal axis between a locked position and an unlocked position with respect to the first tubular sleeve member;

wherein the first shaft segment and the second shaft segment are positioned end-to-end, without overlapping, by the first and second tubular sleeve members to define a handle assembly; and a tool head connected to the handle assembly.

2. The hand tool of claim 1, further comprising a cam mechanism operable to guide the second tubular sleeve member between the locked position and the unlocked position.

3. The hand tool of claim 2, wherein the cam mechanism comprises a cam surface formed in the first tubular sleeve member and a pin extending from the second tubular sleeve member.

4. The hand tool of claim 3, wherein the pin extends perpendicularly to the longitudinal axis.

5. The hand tool of claim 3, wherein the pin slides along the cam surface as the second tubular sleeve member rotates between the unlocked position and the locked position.

6. The hand tool of claim 1, wherein the tool head is removably attachable to handle assembly.

7. The hand tool of claim 6, wherein the tool head is one of a spade shovel, a square shovel, a rake, and a broom.

8. The hand tool of claim 1, wherein the first shaft segment and the second shaft segment comprise wood.

9. The hand tool of claim 1, further comprising a cam mechanism comprising a curved slot and a pin, the cam mechanism disposed on the first tubular sleeve member and the second tubular sleeve member.

10. The hand tool of claim 9, wherein the cam mechanism is operable to guide the second tubular sleeve member between the locked position and the unlocked position.

11. A hand tool comprising:

a first tubular sleeve member extending from an end of a first shaft segment;

the first tubular sleeve member having a socket;

a pair of elongated slots formed in the first tubular sleeve member;

a locking shaft disposed in the elongated slots;

a biasing member biasing said locking shaft;

a second tubular sleeve member extending from an end of a second shaft segment, the second tubular sleeve member configured and dimensioned for insertion into the socket of the first tubular sleeve member, said second tubular sleeve member rotatable about a longitudinal axis between a locked position and an unlocked position in the first tubular sleeve member;

a locking groove formed in an end of the second tubular sleeve member;

wherein said locking shaft automatically engages the locking groove when the second tubular sleeve member is rotated to the locked position;

wherein the first shaft segment and the second shaft segment are connected end-to-end by the first and second tubular sleeve members to define a handle assembly; and a tool head connected to the handle assembly.

12. The hand tool of claim 11, further comprising a release mechanism, wherein said release mechanism disengages the locking shaft from the locking groove when activated to allow the second tubular sleeve member to rotate from the locked position to the unlocked position.

13. The hand tool of claim 11, wherein the tool head is removably attachable to the handle assembly.

14. The hand tool of claim 11, wherein the first shaft segment and the second shaft segment are differing lengths.

15. The hand tool of claim 11, wherein the tool head is one of a spade shovel, a square shovel, a rake, and a broom.

16. The hand tool of claim 11, wherein the handle assembly comprises a grip.

17. The hand tool of claim 16, wherein the grip is one of a straight grip and a D grip.

18. The hand tool of claim 11, wherein the first shaft segment and the second shaft segment comprise wood.

19. The hand tool of claim 18, where the first and second tubular sleeve members comprise metal.

20. The hand tool of claim 19, further comprising fasteners for securing the first and second tubular sleeve members to the first and second shaft segments, respectively.

21. The hand tool of claim 11, a cam mechanism operable to guide the second tubular sleeve member between the locked position and the unlocked position.

22. A modular hand tool kit comprising:

a plurality of handle ends, each of the handle ends having a grip at a first end and an insertion tip at a second end;

a plurality of tool heads comprising a spade shovel, a square shovel, a rake, and a broom, each of the plurality of tool heads comprising an insertion tip;

a plurality of shaft segments, each of the plurality of shaft segments having an insertion tip at a first end and an insertion tip at a second end;

wherein the plurality of shaft segments comprises a first shaft segment and a second shaft segment, wherein the first shaft segment and the second shaft segment differ in length;

a plurality of connector assemblies, each connector assembly comprising:

a first tubular sleeve member defining a first socket and a second socket, a cam surface formed in the first tubular sleeve member, a second tubular sleeve member defining a first socket, a pin extending from the second tubular sleeve member, a pair of elongated slots formed in the first tubular sleeve member, a locking shaft disposed in the elongated slots, a biasing member biasing said locking shaft in the elongated slots, a locking groove formed in a tip of the second tubular sleeve member, wherein the first socket of the first tubular sleeve member and the first socket of the second tubular sleeve member are configured and dimensioned to receive an insertion tip of one of the handle ends, tool heads, or shaft segments, wherein the second tubular sleeve member is configured and dimensioned to be removably inserted into the second socket of the first tubular sleeve member, wherein the second tubular sleeve member is rotatably about a longitudinal axis between a locked position and an unlocked position with respect to the first tubular sleeve member, wherein the locking shaft automatically engages the locking groove when the second shaft segment is rotated to the locked position, and a manual release mechanism operable to disengage the locking shaft from the locking groove;

wherein the plurality of connector assemblies selectably couple the handle ends, tool heads, and shaft segments in a variety of configurations.

23. An apparatus comprising:

a tubular sleeve member defining a first socket;

a pair of elongated slots formed in the tubular sleeve member;

a locking shaft disposed in the elongated slots;

a biasing member biasing said locking shaft;

a first component having a composite insertion tip configured for insertion into the first socket of the tubular sleeve member, said first component rotatable about a longitudinal axis between a locked position and an unlocked position in the tubular sleeve member; and a locking groove formed in the insertion tip of the first component;

wherein said locking shaft engages the locking groove when the first component is rotated to the locked position.

* * * * *